United States Patent [19]

Albrecht et al.

[11] 4,284,179

[45] Aug. 18, 1981

[54] ROLLER ELECTRODE AND PROCESS FOR MAKING SAME

[75] Inventors: Harald Albrecht; Roland Schnettler, both of Schwerte, Fed. Rep. of Germany

[73] Assignee: Maschinen- und Werkzeugbau GmbH, Dortmund-Hombruch, Fed. Rep. of Germany

[21] Appl. No.: 36,995

[22] Filed: May 8, 1979

[51] Int. Cl.[3] ..... C25D 17/06

[52] U.S. Cl. ..... 191/1 A; 204/25; 29/879

[58] Field of Search ..... 191/1 A; 204/25; 29/876, 825, 879

[56] References Cited

U.S. PATENT DOCUMENTS 3,678,226 7/1972 Hatagi ..... 191/1 A

FOREIGN PATENT DOCUMENTS 1235607 6/1971 United Kingdom ..... 191/1 A

*Primary Examiner*—Richard A. Schacher

*Attorney, Agent, or Firm*—Karl F. Ross

[57] ABSTRACT

A roller electrode, to be used for the support of sheet-metal strips in an electrorefining bath, has a hollow-cylindrical steel body spacedly surrounded by steel tubing for the circulation of a cooling fluid. A thin-walled shell of steel or nickel alloy, spacedly enveloping the tubing, defines with the roller body an annular space filled with a mass of lower-melting metal such as copper in which the tubing is embedded. The shell may extend partly around two stub shafts extending integral with the roller body at opposite ends therefrom. In making the electrode, the shell is heated above the melting point of the lower-melting metal which is then introduced in a molten state into the space containing the tubing where it is allowed to harden.

9 Claims, 2 Drawing Figures

ROLLER ELECTRODE AND PROCESS FOR MAKING SAME

FIELD OF THE INVENTION

Our present invention relates to a roller electrode, of the type used for the support of sheet-metal strips or webs to be electrorefined or otherwise electrolytically treated, as well as to a process for making such a roller electrode.

BACKGROUND OF THE INVENTION

Roller electrodes of the type referred to usually carry large electrical currents generating considerable heat. It is therefore necessary to provide them with channels close to the peripheral surface for the circulation of a cooling fluid. Moreover, a significant part of the roller must consist of a metal or alloy of good electrical conductivity in order to provide a low-resistance path between the contact surface of the roller and the associated current supply.

Conventionally, low-resistance material is deposited as a coating on the periphery of a cylindrical roller body of steel or cast iron which is provided with axially extending bores near that periphery for the circulation of the cooling fluid. In a device of this type described in German printed specification No. 1,771,277, for example, the bores constituting the cooling channels are lined with a corrosion-resistant substance and are closed at the ends by covers of conductive sheet metal. The resulting structure is electrolytically coated with a metallic skin consisting of a highly conductive intermediate layer, e.g. of copper, and an outer layer of hard conductive metal such as chromium.

The electrolytic coating of the roller body is time-consuming and correspondingly expensive. The chromium-coated copper layer is prone to wear and is readily attacked by the electrolyte through the rather brittle chromium layer. This may cause local flaking of the chromium, even after relatively short periods of operation; as a result, the treated workpieces—e.g. galvanized or tin-coated webs of sheet steel—are of lower quality. The roller, therefore, requires frequent polishing and possible recoating which is again an expensive procedure. Moreover, the relatively thin chromium layer is also susceptible to mechanical damage by heavier workpieces resting thereon, with development of tiny cracks facilitating penetration of the electrolyte with resulting partial destruction of the copper substrate. The large currents tending to traverse these defective areas may result in scorching of the roller body itself which then becomes unusable.

OBJECTS OF THE INVENTION

The general object of our present invention, therefore, is to provide a roller electrode which is resistant to electrolytic and mechanical attack and which, if damaged, can be repaired in a relatively simple manner.

A related object is to provide a process for making such a roller electrode.

SUMMARY OF THE INVENTION

In accordance with our present invention, a hollow cylindrical body of steel or other suitable material is coaxially surrounded by a thin-walled shell of hard metal with formation of an annular spaced between that shell and the body periphery. The annular space is occupied by conduit means for the circulation of a cooling fluid therethrough and by a filler consisting of a metallic mass of good electrical conductivity and of lower melting point than the hard metal of the shell and the material of the body.

In an advantageous embodiment, the hollow body is integral with two axially extending stub shafts surrounded at least in part by integral sleeves of the shell, the mass of the filler extending into clearances left between the sleeves and the stub shafts.

In forming the roller electrode according to our invention, we first place tubing constituting the aforementioned conduit means around the periphery of the hollow cylindrical body, this tubing consisting of generally axially extending tubes or of one or more coils wound substantially helically about the roller body. Next, a thin-walled metallic jacket is positioned around the body and the tubing to form the aforementioned hard-metal shell. A metallic mass of good electrical conductivity and of lower melting point than the metal of the jacket and the metal of the body is introduced in a molten state into the space existing between the jacket and the body so as to fill that space and to embed the tubing in the molten mass which is thereafter allowed to harden into the above-described filler.

In order to facilitate the casting of the filler, we prefer to separate the tubing from both the roller body and the jacket by suitable spacers. For the same reason it is often desirable to preheat the jacket above the melting point of the metallic mass before pouring same into the annular space between the jacket and the body.

The jacket or shell may consist, for instance, of stainless steel or nickel and could be surface-coated with some other conductive material if desired. The lower-melting mass may consist of copper, brass or aluminum, for example. The tubing, which of course should also be made of a material (e.g. steel) having a higher melting point than the filler material, may be surface-treated with a suitable fluxing agent to promote adherence to the filler; such a flux could also be applied to the outer body surface and the inner jacket surface.

If the roller thus produced needs resurfacing, it may be heated to remelt the filler whereupon the shell can be stripped therefrom and replaced by a new jacket, this step being followed by a reintroduction of the filler mass.

BRIEF DESCRIPTION OF THE DRAWING

The above and other features of our invention will now be described in detail in reference to the accompanied drawing in which.

SPECIFIC DESCRIPTION

Figure 1:
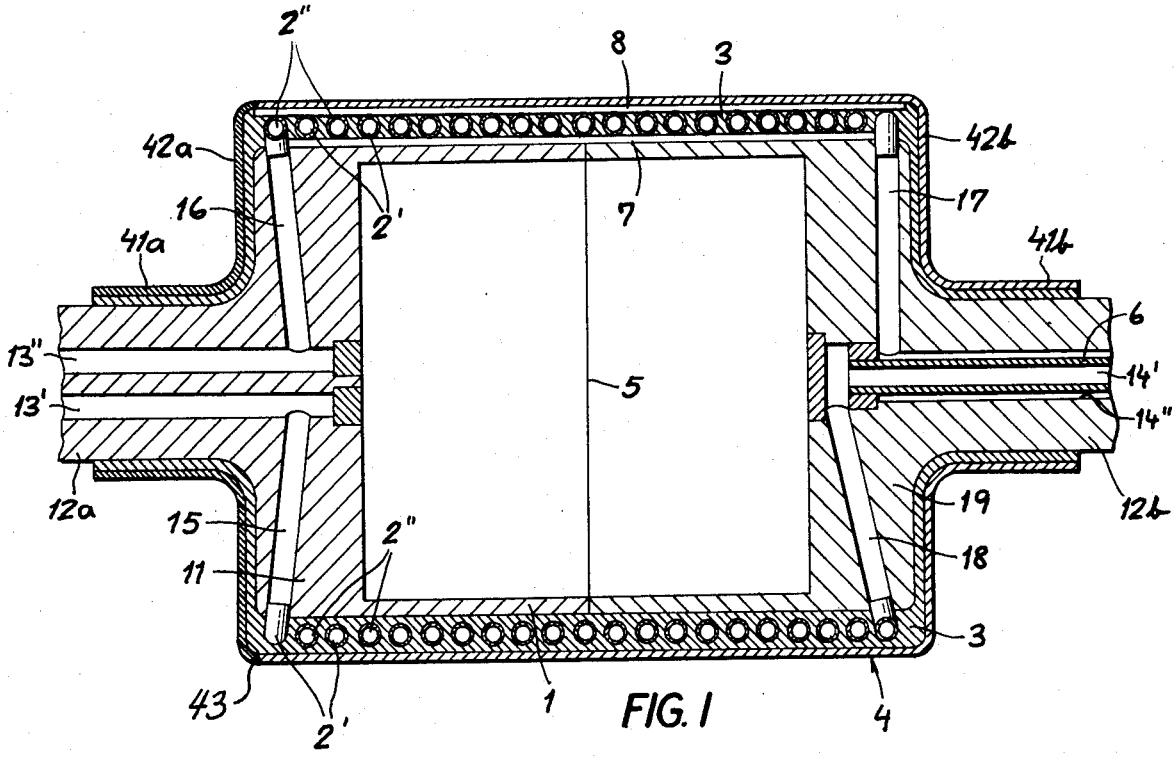
FIG. 1 is an axial sectional view of our improved roller electrode.

As shown in the drawing, a hollow cylindrical body 1 of steel or the like is surrounded by helical tubing 2', 2'' with preferably separated turns resting on axially extending, mutually separated spacer rods 7 (only one shown). Similar spacer rods 8 separate the tubing 2', 2'' from a surrounding jacket 4 whose wall thickness is substantially less than that of body 1 and is only a small fraction of the radial width of the annular clearance existing between members 1 and 4. Jacket 4 consists of two shell portions 42*a*, 42*b* welded together at 43; roller body 1 is divided into two symmetrical halves united by a weld seam 5.

The helically interleaved tubes 2' and 2'' have terminal portions received in generally radial passages 15, 16 and 17, 18 formed in a pair of end walls 11, 19 of body 1, these end walls being integrally extended into respective stub shafts 12*a* and 12*b* which are illustrated only in part. Shell portions 42*a*, 42*b* are similarly extended into respective integral sleeves 41*a*, 41*b*, spacedly surrounding the shafts 12*a*, 12*b*. Passages 15–18 communicate with respective channels 13', 13'' and 14', 14'' which extend axially within stub shafts 12*a* and 12*b*, channels 14', 14'' being concentrically disposed and separated from each other by a tubular partition 6. Channels 13' and 13'', for exaple, may be connected to parallel to a nonillustrated source of cooling fluid which can thus circulate via two separate paths 13', 15, 2', 18, 14' and 13'', 16, 2'', 17, 14'' to a drain not shown.

The space between roller body 1 and jacket 4, including the clearances between shafts 12*a*, 12*b* and sleeves 41*a*, 41*b*, is filled with a mass 3 of a highly conductive metal (e.g. copper) having a lower melting point than the material (e.g. steel) of body 1, jacket 4 and tubing 2', 2''. After the jacket 4 has been preheated above the melting point of mass 3, and advantageously after the application of flux to at least the tubing 2', 2'', the mas 3 is introduced into the intervening space in its molten state, e.g. through the clearance existing between sleeve 41*a* and shaft 12*a* and with air allowed to escape through the opposite clearance between sleeve 41*b* and shaft 12*b*, until the space is completely filled. It will be understood, however, that these clearances could be sealed at their ends and that other openings may be provided for introduction of the molten mass and for escape of the displaced air.

In operation, the roller may be energized with electric current through one or more contacts slidingly engaging, for example, the sleeves 41*a* and 41*b*.

Figure 2:
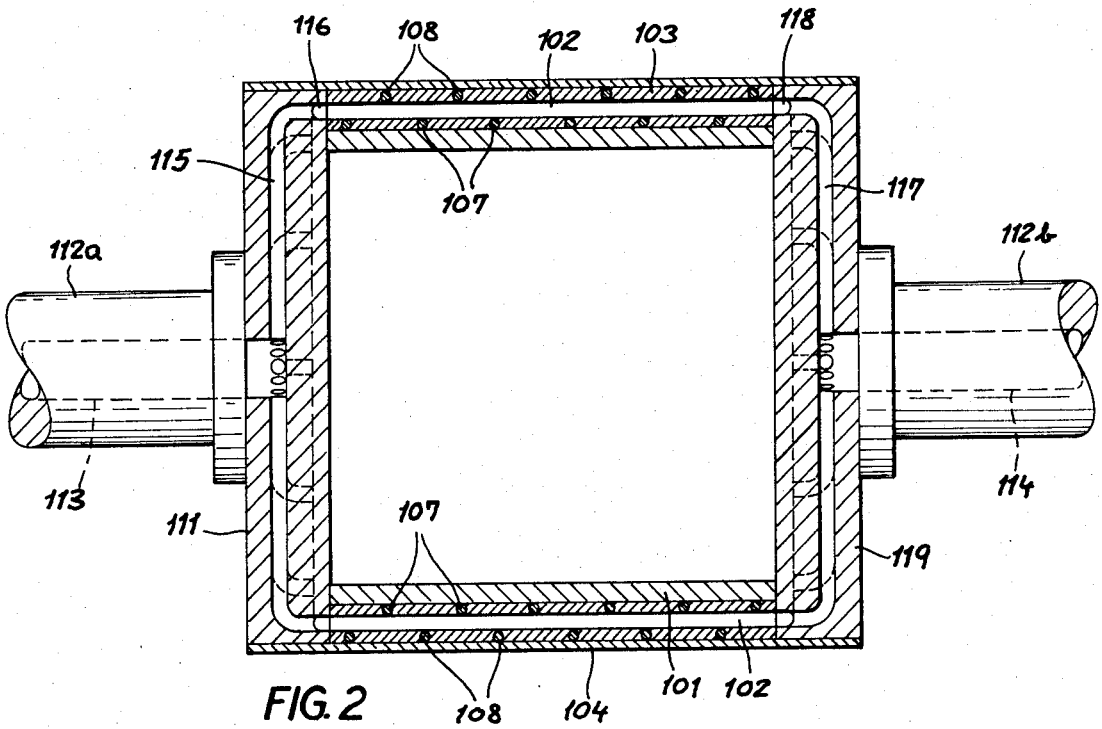
FIG. 2 is a view similar to FIG. 1, illustrating a modification.

FIG. 2 we have shown a generally similar roller electrode comprising a unitary cylindrical body 101 spacedly surrounded by a coaxial cylindrical shell 104, the intervening annular space being occupied by a conductive filler 103 having axially extending tubes 102 embedded therein. The tubes 102 are held separated from the outer body surface and the inner shell surface by spacers 107 and 108 in the form of wire coils with axially separated turns. The ends of the cylinder 101 are closed by metallic disks 111 and 119 which may be welded to it and have channels 115 and 117 that open into annular grooves 116 and 118 communicating with tubes 102. Channels 115 and 117 are also in communication with axial bores 113 and 114 extending within shafts 112*a* and 112*b* that are rigid with end disks 111 and 119, respectively. The manufacture of the roller electrode of FIG. 2 is similar to that described with reference to the device of FIG. 1 and its mode of utilization is the same.

We claim:

1. A roller electrode for the support of sheet-metal strips to be electrolytically treated, comprising:

a hollow cylindrical body;

a thin-walled cylindrical shell of hard metal coaxially surrounding said body with formation of an annular space between said shell and the periphery of said body;

tubing lodged in said space for the circulation of a cooling fluid therethrough, said tubing being separated by spacers from said periphery and said shell; and a filler in said space consisting of a metallic mass of good electrical conductivity and of lower melting point than said hard metal and the material of said body, said tubing being embedded in said mass.

2. A roller electrode as defined in claim 1 wherein said body is integral with a pair of axially extending stub shafts, said shell forming two integral sleeves surrounding at least a portion of each of said stub shafts with intervening clearances, said filler extending into said clearances.

3. A roller electrode as defined in claim 2 wherein said body has generally radial passages communicating with said conduit means and with channels extending axially outward through said stub shafts.

4. A roller electrode as defined in claim 1, 2 or 3 wherein said tubing is wound about said periphery in a multiplicity of axially separated turns.

5. A roller electrode for the support of sheet-metal strips to be electrolytically treated, comprising:

a hollow cylindrical body integral with a pair of axially extending stub shafts;

a thin-walled cylindrical shell of hard metal coaxially surrounding said body with formation of an annular space between said shell and the periphery of said body, said shell forming two integral sleeves surrounding at least a portion of each of said stub shafts with intervening clearances;

conduit means lodged in said space for the circulation of a cooling fluid therethrough; and a filler in said space and in said clearances consisting of a metallic mass of good electrical conductivity and of a lower melting point than said hard metal and the material of said body, said conduit means being embedded in said mass.

6. A process for making a roller electrode to be used for supporting sheet-metal strips to be electrolytically treated, comprising the steps of:

providing a hollow cylindrical body;

placing tubing around the periphery of said body to form a path for the circulation of a cooling fluid;

coaxially surrounding said body and said tubing with a thin-walled jacket of hard metal with formation of an annular space between said jacket and said periphery; introducing a metallic mass of good electrical conductivity and of lower melting point than said hard metal and the material of said body in a molten state into said space to fill the latter and to embed said tubing therein; and allowing the introduced metallic mass to harden in said space.

7. A process as defined in claim 6, comprising the further step of heating said jacket above the melting point of said metallic mass before introducing same into said space.

8. A process as defined in claim 6 or 7, comprising the further step of externally treating said tubing with a flux before introducing said metallic mass into said space.

9. A process as defined in claim 6 or 7 wherein said jacket is made of nickel or steel, said metallic mass being copper, brass or aluminum.

* * * * *